US008127952B2

(12) United States Patent
Grubba

(10) Patent No.: US 8,127,952 B2
(45) Date of Patent: Mar. 6, 2012

(54) MODEL TRAIN COUPLER WITH LINEAR ACTUATOR

(76) Inventor: Robert Grubba, Ormond Bch, FL (US)

( * ) Notice: Subject to any disclaimer, the term of this patent is extended or adjusted under 35 U.S.C. 154(b) by 143 days.

(21) Appl. No.: 12/799,157

(22) Filed: Apr. 20, 2010

(65) Prior Publication Data

US 2011/0253664 A1 Oct. 20, 2011

(51) Int. Cl.
*A63H 19/18* (2006.01)

(52) U.S. Cl. ..... 213/75 TC

(58) Field of Classification Search ..... 213/75 TC, 213/75 R, 88, 89, 90, 100 R, 104, 175, 211
See application file for complete search history.

(56) References Cited

U.S. PATENT DOCUMENTS 3,112,036 A * 11/1963 Frazer ..... 213/212
3,801,954 A 4/1974 Dorrell
5,024,549 A 6/1991 Dalby
5,108,214 A 4/1992 Milam
5,119,555 A 6/1992 Johnson
5,129,753 A 7/1992 Wesley et al.
5,192,147 A 3/1993 McCloskey
5,312,152 A 5/1994 Woebkenberg, Jr. et al.
5,674,027 A 10/1997 Warnaar
5,718,531 A 2/1998 Mutschler, Jr. et al.
5,771,742 A 6/1998 Bokaie et al.
5,931,322 A * 8/1999 Storzek ..... 213/75 TC
6,308,845 B1 * 10/2001 Sergent, IV ..... 213/75 TC
6,450,725 B1 9/2002 Roth et al.
6,972,659 B2 12/2005 von Behrens et al.
6,994,224 B2 * 2/2006 Barger et al. ..... 213/75 TC
7,694,834 B2 * 4/2010 Wolf et al. ..... 213/75 TC
7,775,385 B2 * 8/2010 Dudley ..... 213/75 TC
2002/0102130 A1 8/2002 Nygren et al.

* cited by examiner

*Primary Examiner* — S. Joseph Morano
*Assistant Examiner* — Zachary Kuhfuss
(74) *Attorney, Agent, or Firm* — J. Wiley Horton

(57) ABSTRACT

A model train coupler which can be opened using a remote signal. The coupler design includes an upper arm and a lower arm, both of which pivot around a common axis. The two arms are mounted in a coupler box which is attached to a piece of rolling stock. One of the arms includes a knuckle located outside the coupler box. The other arm includes a latch positioned to open and close against the knuckle. A linear actuator links the two arms together. When an electrical current is applied to the linear actuator, the latch is rotated away from the knuckle, thereby opening the coupler.

20 Claims, 6 Drawing Sheets

MODEL TRAIN COUPLER WITH LINEAR ACTUATOR

BACKGROUND OF THE INVENTION

1. Field of the Invention

This invention relates to the field of model trains. More specifically, the invention comprises a model train coupler incorporating an electrically-controlled linear actuator which allows model train cars to be de-coupled using a remote signal.

2. Description of the Related Art

The overriding goal of the components found in a model train system is the faithful reproduction of the operation of a full-size train. The inclusion of sophisticated electronics and the use of Digital Command Control ("DCC") have allowed a substantial increase in operation realism. One exception, however, is the state of the coupling devices which are used to selectively connect and disconnect the locomotives and cars making up a train.

Most model train users desire to operate the model train "layout" without having to manually interact with the rolling stock (the locomotives and cars). Modern power and control systems allow the user to accurately run the locomotives at desired speeds and with the desired running characteristics. The user is also able to remotely control switch turn-outs, lighting, sound effects, and a host of other features.

In the operation of full size trains it is necessary to move and arrange cars in order to create a desired configuration which will then be attached to a locomotive to create a train. Such operations are performed in switching yards, where numerous individual moves are made by coupling and de-coupling single cars and short groups of cars.

The couplers traditionally used in model trains allow a user to couple two pieces of rolling stock by pushing them together. The speeds required to create a coupling have often been unrealistically high, but at least the "push to couple" feature is functional. An example of a traditional coupler design is disclosed in U.S. Pat. No. 5,620,106 to Storzek (1997), which is hereby incorporated by reference.

The Storzek device also creates a reasonable facsimile of the appearance of a full size train coupler. Its operation is completely different, but this is not visually apparent to the user. The main disadvantage of a device such as disclosed in Storzek is the requirement that the user manually intervene in order to de-couple two pieces of rolling stock.

A manual de-coupling tool is shown in Storzek's FIG. 6. The use of this tool is described with respect to FIGS. 7A-7H. The tool must be inserted between the couplers and rotated to release the interlocking of the mated pair of couplers. The Storzek device works well, but as mentioned previously, manual intervention by a model train operator is generally undesirable.

Couplers which may be uncoupled using a remote signal are known in the art. One good example is the KADEE automatic coupler manufactured by Kadee Quality Products Co. of White City, Oreg. This design pivots open when placed in a strong magnetic field. An electromagnet is generally placed beneath the track at a fixed location. The user operates the model train to place a specific pair of mated couplers directly over the magnet. The user then actuates the magnet, which decouples the mated pair.

The KA-DEE type of coupler is obviously limited by the fact that it can only be operated over the fixed position of the electromagnet. This was once an acceptable limitation. However, the advent of the DCC digital communication protocol allows commands to be sent over the rails themselves. DCC commands permit most train operations to be carried out in any location on the model train layout. Thus, the requirement that the de-coupling operation be carried out in one specific location is an undesirable limitation.

It would therefore be desirable to provide a coupler which can be de-coupled using a signal sent over the rails of the model train layout (such as a DCC signal). It would also be desirable for such a coupler to remain compatible with existing coupler designs so that the user is not forced to change every coupler on every piece of rolling stock. The present invention proposes just such a coupler design.

BRIEF SUMMARY OF THE PRESENT INVENTION

The present invention comprises a model train coupler which can be opened using a remote signal. The coupler design includes an upper arm and a lower arm, both of which pivot around a common axis. The two arms are mounted in a coupler box which is attached to a piece of rolling stock. One of the arms includes a knuckle located outside the coupler box. The other arm includes a latch positioned to open and close against the knuckle. When the latch is closed against the knuckle, a pocket forms. This pocket cooperates with a pocket on an adjoining coupler to create a mated pair of couplers.

The arm including the knuckle has a first protruding lever located on the side of the axis that is opposite the knuckle. The arm including the latch has a second protruding lever located on the side of the axis that is opposite the latch. The first and second levers are configured to provide a gap therebetween—akin to the handles of a pair of pliers. A compression spring is located in this gap, with the compression spring being positioned to urge the two levers apart and thereby urge the latch against the knuckle. A linear actuator is also located in this gap. When an electrical current is applied to the linear actuator, the two levers are pulled together. This action urges the latch away from the knuckle and opens the coupler.

The linear actuator is preferably attached to a decoder located within the piece of rolling stock. The decoder preferably receives signals over the rails—such as a DCC signal. Thus, a signal sent over the rails may be used to open the coupler in any desired location on the model train layout.

REFERENCE NUMERALS IN THE DRAWINGS

Figure 1:
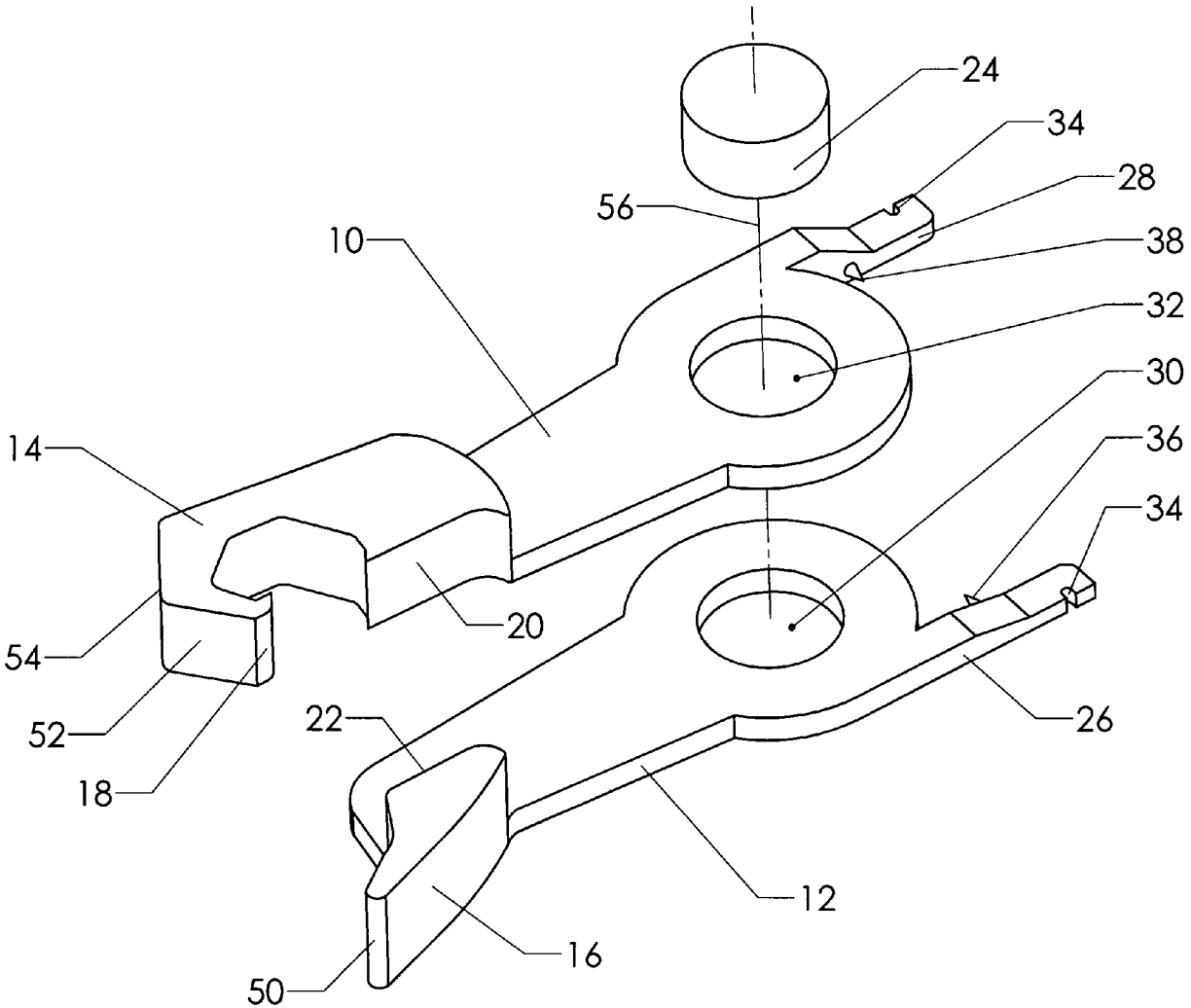
FIG. 1 is an exploded perspective view, showing some of the components of the present invention in an exploded state.

| | | | |
|---|---|---|---|
| 10 | upper arm | 12 | lower arm |
| 14 | knuckle | 16 | latch |

-continued

| REFERENCE NUMERALS IN THE DRAWINGS | | | |
|---|---|---|---|
| 18 | tip | 20 | mating surface |
| 22 | mating surface | 24 | pivot pin |
| 26 | lower lever | 28 | upper lever |
| 30 | lower pin receiver | 32 | upper pin receiver |
| 34 | slot | 36 | locating stud |
| 37 | locating stud | 38 | linear actuator |
| 40 | electrical lead | 42 | compression spring |
| 44 | pocket | 45 | coupler box |
| 46 | top | 48 | side wall |
| 49 | floor | 50 | tip |
| 52 | inner beveled surface | 54 | outer beveled surface |
| 56 | axis | | |

DETAILED DESCRIPTION OF THE INVENTION

FIG. 1 shows the basic components of the present invention in an exploded state. Upper arm 10 and lower arm 12 are designed to pivot about axis 56 in a fashion similar to the legs of a pair of pliers. Upper arm 10 is an elongated element having upper pin receiver 32 in its middle portion. The upper pin receiver 32 is sized to receive pivot pin 24. Upper arm 10 has knuckle 14 located on a first end and upper lever 28 located opposite the knuckle.

Lower arm 12 is an elongated element having lower pin receiver 30 in its middle portion. The lower pin receiver is also sized to receive pivot pin 24. Lower arm 12 has latch 16 on a first end and lower arm 26 located opposite the latch. Latch 16 and knuckle 14 are designed to bear against each other when the coupler is in a closed state. Hence, knuckle 14 includes mating surface 20 which is positioned to bear against mating surface 22 on latch 16.

The reader should bear in mind that the terms "upper" and "lower" (as well as other direction terms used herein) refer to the specific embodiment shown in the view and should not be viewed as limiting. One could—for example, attach the knuckle to the lower arm and the latch to the upper arm. Although changes in the geometry would be required, the device would function in the same way.

Figure 2:
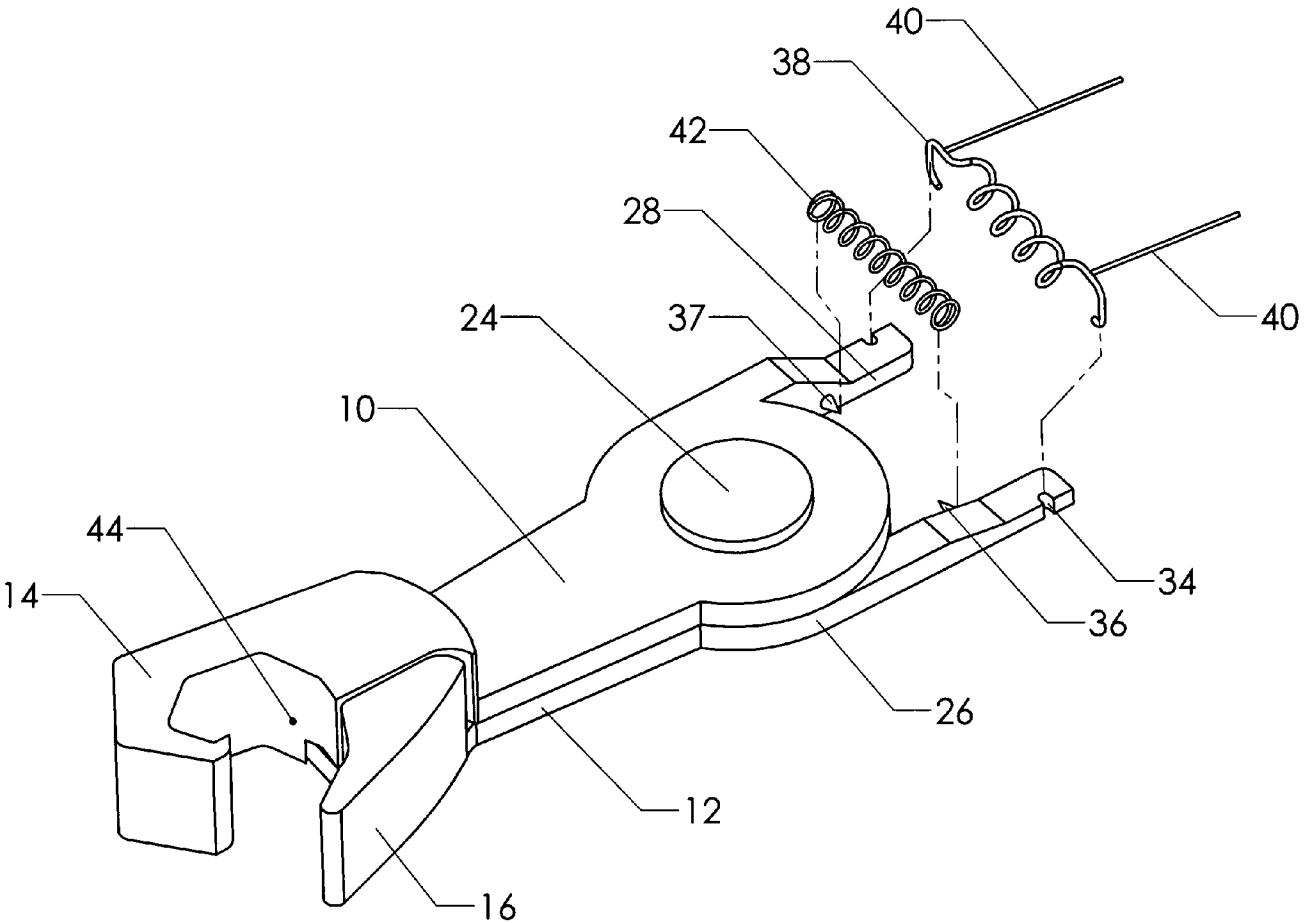
FIG. 2 is an exploded perspective view, showing the components of FIG. 1 with the addition of a compression spring and a linear actuator.

FIG. 2 shows upper arm 10 and lower arm 12 pivotally mounted on pin 24. Knuckle 14 and latch 16 are pressed together to form pocket 44 (shown in the "closed" state). The reader will observe how lower lever 26 and upper lever 28 extend in a direction which is opposite the location of the knuckle and latch. The upper and lower levers serve to open and close pocket 44. When the upper and lower levers are urged toward each other, knuckle 14 and latch 16 are urged away from each other. When the upper and lower levers are urged away from each other, knuckle 14 and latch 16 are urged toward each other and typically close to form pocket 44.

The reader should note that the upper and lower levers actually lie in a common plane. The term "upper lever" is used to indicate that the upper lever is connected to the upper arm. Likewise the term lower lever is used to indicate that the lower lever is connected to the lower arm. The upper lever includes a "dogleg" bend which places it in the same plane as the lower lever. Of course, one could provide both levers with a smaller dog leg bend to place them in a common middle plane. These are all design choices.

A spring device is preferably provided to urge the knuckle and the latch toward each other—thereby making the closed position the default state. Several different types of device can perform this function. A torsional spring is one good example. In the embodiment shown in FIG. 2, compression spring 42 is placed between the upper and lower levers to urge them apart. The compression spring is preferably retained by positive locating features—such as locating stud 36 on lower lever 26 and locating stud 37 on upper lever 28. These features prevent the spring from dislocating as the device moves through its range of motion.

A linear actuator is provided to urge the upper and lower levers together when the user desires to open pocket 44 by urging latch 16 away from knuckle 14. A "linear actuator" is any device which selectively changes its length. One example is a solenoid. A second example is a lead screw. Because the assembly shown in FIG. 2 is typically quite small (The "pocket" is only about 3 to 4 mm across in an HO scale model train) a simple device is preferably used for the linear actuator. Linear actuator 38 in the embodiment of FIG. 2 is a coil of nitinol wire.

The nitinol coil includes end portions designed to engage a slot 34 in each of the levers so that the wire will remain in position. Any suitable retention features may be used and the engagement of the portions of the coil with the two slots is properly viewed as being only one option among many.

Those skilled in the art will know that nitinol displays unusual properties when subjected to an electrical current. The electrical current is preferably regulated to heat the nitinol wire to an appropriate temperature. This causes the wire to contract, thereby pulling the upper and lower levers toward each other (and urging the knuckle and latch apart). When the electrical current is switched off, the nitinol wire rapidly cools and reverts to its original length. Thus, the nitinol wire serves as an electrically controlled linear actuator. The use of a coiled shape is optional. A simple loop of nitinol wrapped around the upper and lower levers (one or more times) could also function as a linear actuator.

Figure 3:
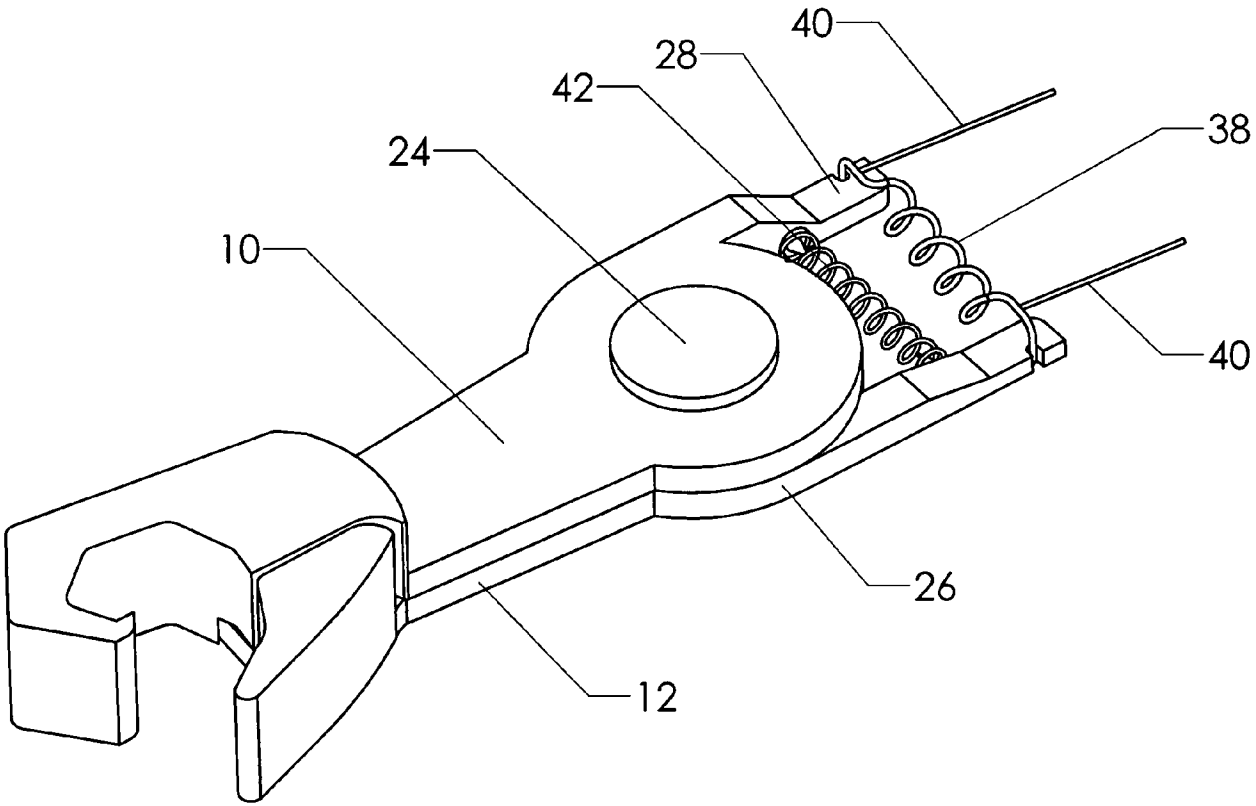
FIG. 3 is a perspective view, showing the compression spring and the linear actuator in an assembled state.

FIG. 3 shows the assembly of FIG. 2 with compression spring 42 and linear actuator 38 in position. Electrical leads 40 are provided with suitable flexibility so that they may move as the coupler opens and closes. The amount of current required to operate the linear actuator is quite small. Thus, the electrical leads can be thin and flexible.

Figure 4:
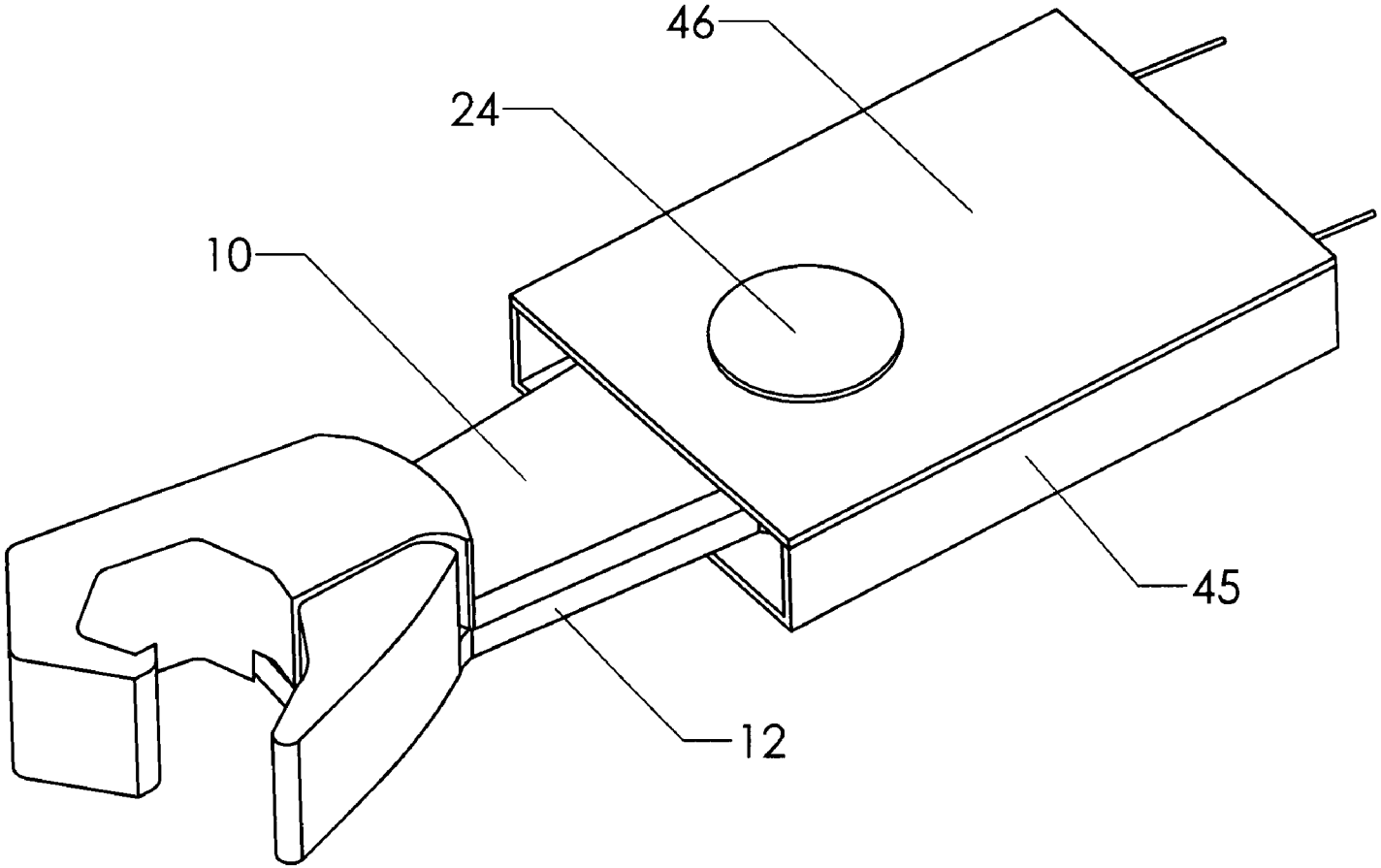
FIG. 4 is a perspective view, showing the coupler components placed inside a coupler box.

Most rolling stock used with model trains is equipped with a coupler box 45—as shown in FIG. 4. The coupler box is attached to the rolling stock. Some type of pivot pin 24 is provided to mount the coupler assembly as shown. The term "pivot pin" should be broadly interpreted to include any type of device about which the coupler arms can rotate. The pin may be part of a threaded device which is screwed into the coupler box. In some embodiments the pin may be a journal that is molded integrally with a portion of the coupler box itself.

Coupler boxes are often equipped with a removable top 46 to facilitate assembly/disassembly. The "top" may be on the top or the bottom of the assembly as it is oriented when attached to the piece of rolling stock.

Figure 5:
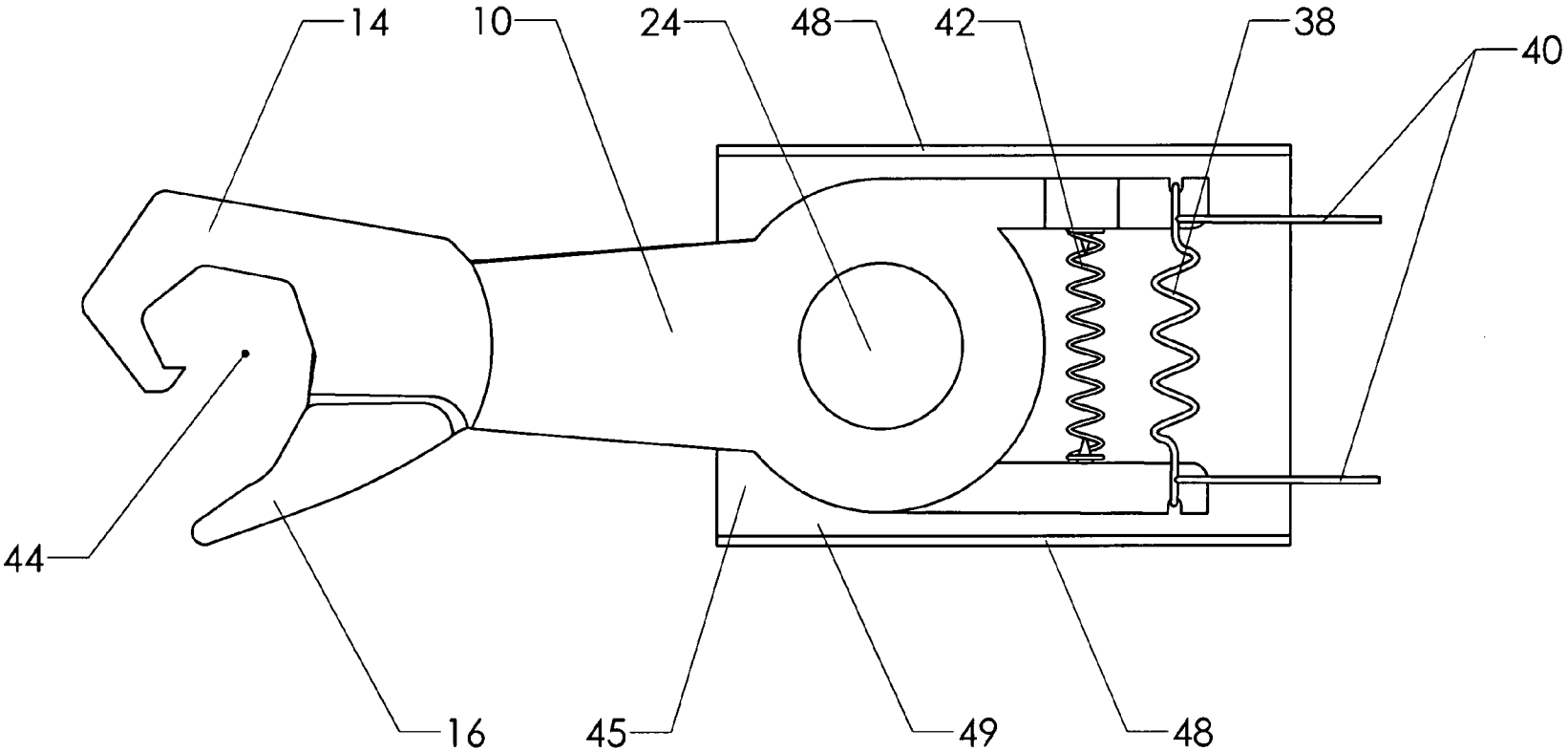
FIG. 5 is a plan view, showing the operation of the coupler components.

FIG. 5 shows a plan view of the coupler assembly—including coupler box 45 with top 46 removed so that the components may be seen. The upper and lower arms are assembled on pivot pin 24. In this view the reader may easily see how pivot pin 24 may be part of the coupler box and may even be a cylindrical stud sticking up from floor 49 of coupler box 45. The entire coupler assembly is free to rotate through a limited range. This is necessary to allow the rolling stock to pass around curves in the track. The limitation is limited by the coupler assembly bearing against one of the side walls 48 of the coupler box.

FIG. 5 shows the coupler in the "closed" state—with latch 16 bearing against knuckle 14 to form pocket 44. Compression spring 42 preserves the closed state by urging the knuckle and latch toward each other. If an electrical current is provided through electrical leads 40, however, the state of the device will change. Applying sufficient electrical current causes linear actuator 38 to shrink—thereby urging the upper and lower levers together and urging latch 16 and knuckle 14 away from each other.

Figure 6:
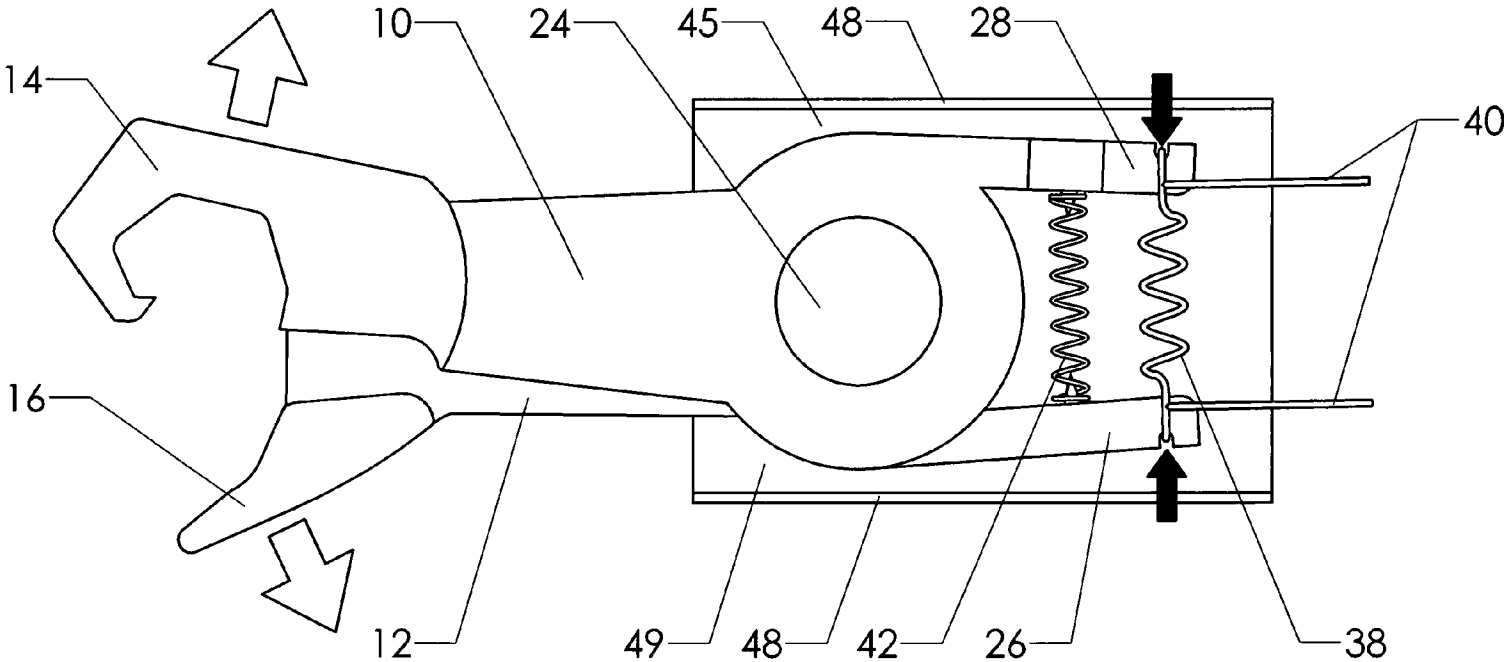
FIG. 6 is a plan view, showing the operation of the coupler components.

FIG. 6 shoes the resulting motion—as indicated by the arrows. The opening of upper arm 10 and lower arm 12 may be limited by a mechanical stop mechanism created between the two. It may also be limited by a limit on the electrical current applied and the limit on motion of the nitinol coil. In any event, the linear actuator should provide an amount of motion sufficient to open the coupler as shown.

The coupling and uncoupling of a device using this geometry is well described in the incorporated Storzek patent (U.S. Pat. No. 5,620,106). Specifically, Storzek's FIG. 5 shows the steps of the coupling process while Storzek's FIG. 7 shows the steps of the uncoupling process. Of course, the present invention does not use a manual uncoupling tool. Instead, the electrical actuation of the linear actuator opens the present coupler and uncouples it from its neighbor.

Returning now to FIG. 1, the reader will observe that knuckle 14 includes outer beveled surface 54 and inner beveled surface 52. These are designed to interact with tip 50 of latch 16 on another coupler. Storzek's FIG. 5 illustrates this process. Inner beveled surface 52 on a first coupler bears against a mating inner beveled surface 52 on a second coupler. This pivots both couplers until outer beveled surface 54 bears against tip 50 and urges the latch away from the knuckle (as shown in Storzek's FIG. 5C).

Therefore, when two couplers built according to the present design are pushed together—they tend to couple together. This is true irrespective of the speed of contact (within reason). Thus, two pieces of rolling stock employing the present couplers may be coupled by pushing them gently together—which is similar to the operation of a full size train.

When uncoupling a coupled pair, one can open both couplers by actuating the linear actuator found in each coupler. Of course, it is preferable to provide geometry allowing a coupled pair to be uncoupled by actuating only one of the two members of the coupled pair. As an example, it may be desirable to couple an "active" coupler built according to the present invention with a passive coupler such as is disclosed in Storzek. The knuckle and latch geometry can be provided such that opening only one member of the coupled pair will uncouple the pair. This feature allows the present invention to be used with older technology.

The reader may wish to know some concepts regarding how the present invention can be remotely controlled. The preferred embodiment uses the widely known DCC technology. In DCC, a microprocessor is placed aboard the piece of rolling stock. This microprocessor is included in a device known as a "decoder." The decoder receives digital instructions transmitted over the rails and performs certain functions as a result.

As one example, a box car can be provided with a DCC decoder and a pair of couplers constructed according to the present invention which are electrically connected to the DCC decoder. Within the DCC system, the box car is assigned a specific identifier. The model train operator uses a DCC "command station" to send DCC commands over the rails. The user can transmit a DCC command directing that only the decoder on board the specific boxcar open its two couplers. Of course, the decoder on board the box car may also be configured to control its two couplers independently.

Using this approach, the model train operator may selectively operate any coupler at any point on the layout. DCC also allows grouping of commands so that a set of rolling stock could have its couplers opened simultaneously.

The reader should bear in mind that DCC is not the only available protocol allowing the use of digital commands over the rails. Numerous other systems are known and the present invention could work with any of them. The invention could also function in an analog format by using a filtering device to supply current to the linear actuator only when a special signal is sent (such as an AC signal on top of analog DC).

Although the preceding description contains significant detail, it should not be construed as limiting the scope of the invention but rather as providing illustrations of the preferred embodiments of the invention. Numerous other permutations and modifications will be apparent to those skilled in the art. As an example, the upper and lower levers need not be aligned with the long axis of the upper and lower arms in order to perform their intended function. These other embodiments are still within the scope of the invention. Thus, the scope of the invention should be fixed by the following claims rather than the examples given.

Having described my invention, I claim:

1. A model railroad car coupler, comprising:

a. a first arm, including a first end, a second end, and a middle therebetween;

b. said first arm including a knuckle located on said first end of said first arm;

c. said first arm including a first lever on said second end of said first arm;

d. a second arm, including a first end, a second end, and a middle therebetween;

e. said second arm including a latch on said first end of said second arm;

f. said second arm including a second lever on said second end of said second arm;

g. said middle of said second arm being pivotally connected to said middle of said first arm;

h. a spring for biasing said latch toward said knuckle; and i. a linear actuator attaching said second lever to said first lever, said linear actuator contracting in response to an electrical signal, thereby pulling said first and second levers together.

2. A model railroad car coupler as recited in claim 1, wherein said linear actuator includes nitinol wire.

3. A model railroad car coupler as recited in claim 2, wherein a portion of said nitinol wire is formed into a coil.

4. A model railroad car coupler as recited in claim 1, wherein said spring is a compression spring located between said first and second levers.

5. A model railroad car as recited in claim 1, wherein said electrical signal is provided by a DCC decoder.

6. A model railroad car coupler as recited in claim 1, wherein said first and second arms are partially enclosed by a coupler box.

7. A model railroad car coupler as recited in claim 5, wherein said first and second arms are pivotally connected to said coupler box.

8. A model railroad car coupler, comprising:

a. an upper arm;

b. a lower arm pivotally connected to said upper arm;

c. one of said upper and lower arms including a knuckle;

d. the other of said upper and lower arms including a latch positioned to bear against said knuckle;

e. a spring for biasing said latch toward said knuckle;

f. an upper lever attached to said upper arm;

g. a lower lever attached to said lower arm;

h. a linear actuator attaching said upper lever to said lower lever, said linear actuator contracting in response to an electrical signal, thereby pulling said upper and lower levers together; and i. said upper and lower levers positioned so that pulling said upper and lower levers together pulls said knuckle and said latch apart.

9. A model railroad car coupler as recited in claim 8, wherein said linear actuator includes nitinol wire.

10. A model railroad car coupler as recited in claim 9, wherein a portion of said nitinol wire is formed into a coil.

11. A model railroad car coupler as recited in claim 8, wherein said spring is a compression spring located between said first and second levers.

12. A model railroad car as recited in claim 9, wherein said electrical signal is provided by a DCC decoder.

13. A model railroad car coupler as recited in claim 8, wherein said first and second arms are partially enclosed by a coupler box.

14. A model railroad car coupler as recited in claim 13, wherein said first and second arms are pivotally connected to said coupler box.

15. A model railroad car, comprising:

a. a first arm with a knuckle;

b. a second arm with a latch, said second arm being pivotally connected to said first arm so that when said second arm pivots in a first direction with respect to said first arm, said latch bears against said knuckle;

c. a spring urging said second arm in said first direction with respect to said first arm;

d. a first lever connected to said first arm;

e. a second lever connected to said second arm;

f. a linear actuator attaching said first lever to said second lever, said linear actuator contracting in response to an electrical signal, thereby pulling said first and second levers together; and g. said first and second levers positioned so that pulling said first and second levers together pivots said second arm in a second direction with respect to said first arm.

16. A model railroad car coupler as recited in claim 15, wherein said linear actuator includes nitinol wire.

17. A model railroad car coupler as recited in claim 16, wherein a portion of said nitinol wire is formed into a coil.

18. A model railroad car coupler as recited in claim 15, wherein said spring is a compression spring located between said first and second levers.

19. A model railroad car as recited in claim 15, wherein said electrical signal is provided by a DCC decoder.

20. A model railroad car coupler as recited in claim 15, wherein said first and second arms are partially enclosed by a coupler box.

* * * * *